US008922597B2

(12) United States Patent
Nakai et al.

(10) Patent No.: US 8,922,597 B2
(45) Date of Patent: Dec. 30, 2014

(54) LIQUID CRYSTAL DISPLAY DEVICE

(75) Inventors: Takashi Nakai, Chiba (JP); Goki Toshima, Chiba (JP); Ryutaro Oke, Chiba (JP); Junichi Maruyama, Chiba (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 225 days.

(21) Appl. No.: 13/415,457

(22) Filed: Mar. 8, 2012

(65) Prior Publication Data

US 2012/0229525 A1 Sep. 13, 2012

(30) Foreign Application Priority Data

Mar. 10, 2011 (JP) ..... 2011-052649

(51) Int. Cl.
*G09G 3/36* (2006.01)

(52) U.S. Cl.
CPC ..... *G09G 3/3614* (2013.01); *G09G 3/3648* (2013.01); *G09G 3/3688* (2013.01); *G09G 2320/0223* (2013.01); *G09G 2320/0257* (2013.01); *G09G 2320/0204* (2013.01)
USPC ..... 345/690; 345/89

(58) Field of Classification Search
CPC ..... G09G 2310/027; G09G 2320/0271; G09G 3/36; G09G 5/10; G09G 3/3614; G09G 2300/0283; G09G 2310/0254
See application file for complete search history.

(56) References Cited

U.S. PATENT DOCUMENTS

| | | | | |
|---|---|---|---|---|
| 6,266,039 | B1 | 7/2001 | Aoki | |
| 2004/0196243 | A1 * | 10/2004 | Masutani et al. | 345/96 |
| 2006/0152462 | A1 * | 7/2006 | Furihata et al. | 345/98 |
| 2006/0158413 | A1 * | 7/2006 | Morita | 345/94 |
| 2008/0012840 | A1 | 1/2008 | Higashino et al. | |
| 2008/0204439 | A1 | 8/2008 | Morita | |
| 2009/0040244 | A1 | 2/2009 | Lee et al. | |
| 2010/0045708 | A1 | 2/2010 | Higashino | |
| 2011/0205260 | A1 | 8/2011 | Weng et al. | |
| 2011/0221760 | A1 | 9/2011 | Irie et al. | |

FOREIGN PATENT DOCUMENTS

| | | |
|---|---|---|
| JP | 2004-219824 | 8/2004 |
| JP | 3704716 | 8/2005 |

* cited by examiner

*Primary Examiner* — Srilakshmi Kumar
*Assistant Examiner* — Carl Adams
(74) *Attorney, Agent, or Firm* — Hamre, Schumann, Mueller & Larson, P.C.

(57) ABSTRACT

A liquid crystal display device includes a plurality of pixel circuits, data lines, and a data-line driving circuit connected to the data lines. Each of the pixel circuits includes a pixel capacitance having one end provided with a common potential. In accordance with a grayscale value for one of the plurality of pixel circuits, the data-line driving circuit selectively outputs a positive-polarity signal and a negative-polarity signal to the one pixel circuit. The data-line driving circuit outputs the positive-polarity signal and the negative-polarity signal so that an average of a potential of the positive-polarity signal and a potential of the negative-polarity signal corresponding to the grayscale value changes in accordance with the grayscale value, a temperature, and a position of the one pixel circuit.

6 Claims, 7 Drawing Sheets

FIG.6

| | | DI | | | | | | | | |
|---|---|---|---|---|---|---|---|---|---|---|
| | | 0 | 32 | 64 | 96 | 128 | 160 | 192 | 224 | 255 |
| LDI | 0 | 0 | 32 | 92 | 94 | 81 | 62 | 40 | 19 | ··· |
| | 32 | ··· | 0 | 24 | 41 | 47 | 46 | ··· | | |
| | 64 | | ··· | 0 | ··· | | | | | |
| | 92 | | | ··· | 0 | ··· | | | | |
| | 128 | | | | ··· | 0 | ··· | | | |
| | 160 | | | | | ··· | 0 | ··· | | |
| | 192 | | | | | | ··· | 0 | ··· | |
| | 224 | | | | | | | ··· | 0 | ··· |
| | 255 | | | | | | | | ··· | 0 |

FIG.7

| | | DI | | | | | | | | |
|---|---|---|---|---|---|---|---|---|---|---|
| | | 0 | 32 | 64 | 96 | 128 | 160 | 192 | 224 | 255 |
| LDI | 0 | 0 | 32 | 92 | 24 | 27 | 28 | 24 | 14 | ··· |
| | 32 | ··· | 0 | 24 | 41 | 0 | 8 | ··· | | |
| | 64 | | ··· | 0 | ··· | | | | | |
| | 92 | | | ··· | 0 | ··· | | | | |
| | 128 | | | | ··· | 0 | ··· | | | |
| | 160 | | | | | ··· | 0 | ··· | | |
| | 192 | | | | | | ··· | 0 | ··· | |
| | 224 | | | | | | | ··· | 0 | ··· |
| | 255 | | | | | | | | ··· | 0 |

| | | DI | | | | | | | | |
|---|---|---|---|---|---|---|---|---|---|---|
| | | 0 | 32 | 64 | 96 | 128 | 160 | 192 | 224 | 255 |
| LDI | 0 | – | ○ | △ | × | × | × | × | × | × |
| | 32 | ○ | – | ○ | △ | × | × | × | × | × |
| | 64 | ○ | ○ | – | ○ | △ | × | × | × | × |
| | 96 | ○ | ○ | ○ | – | ○ | △ | × | × | × |
| | 128 | ○ | ○ | ○ | ○ | – | △ | × | × | × |
| | 160 | ○ | ○ | ○ | ○ | ○ | – | × | × | × |
| | 192 | ○ | ○ | ○ | ○ | ○ | ○ | – | × | × |
| | 224 | ○ | ○ | ○ | ○ | ○ | ○ | ○ | – | × |
| | 255 | ○ | ○ | ○ | ○ | ○ | ○ | ○ | ○ | – |

LIQUID CRYSTAL DISPLAY DEVICE

CROSS-REFERENCE TO RELATED APPLICATION

The present application claims priority from Japanese application JP 2011-052649 filed on Mar. 10, 2011, the content of which is hereby incorporated by reference into this application.

BACKGROUND OF THE INVENTION

1. Field of the Invention

The present invention relates to a liquid crystal display device, in particular, a data-line driving circuit included in a liquid crystal display device.

2. Description of the Related Art

A liquid crystal display device uses a potential difference between a pixel electrode and a common electrode that are included in each of the pixel circuits to control a transmittance of liquid crystal. In the case where a time average of a potential applied to a pixel electrode of any one of the pixel circuits deviates from a common potential applied to the common electrode (this case is referred to as the application of a DC component to the liquid crystal), the relation between the transmittance of the liquid crystal and the potential difference is not maintained any more to result in the generation of a ghost image. In the liquid crystal display device, polarity of the potential applied to the pixel electrode changes for each frame to prevent the generation of the ghost image. The polarity indicates that the potential applied to the pixel electrode or a data line is higher or lower than the common potential. A positive-polarity potential indicates that the potential is higher than the common potential, whereas a negative-polarity potential indicates that the potential is lower than the common potential.

Even when an average of the positive-polarity potential and the negative-polarity potential applied to the data line for a certain level of grayscale is equal to the common potential, the ghost image is disadvantageously generated in some cases. This is because the average of the positive-polarity potential and the negative-polarity potential applied to the pixel electrode differs from the common potential in this case. Therefore, conventionally, control for shifting the average of the positive-polarity potential and the negative-polarity potential applied to the data line from the common potential by a predetermined value is performed.

Japanese Patent No. 3704716 discloses a liquid crystal display device for shifting positive-polarity and negative-polarity precharge potentials applied to a data line from a central potential of a data voltage amplitude by a predetermined value. Japanese Patent Application Laid-open No. 2004-219824 discloses a liquid crystal display device for controlling whether or not to perform precharging for a pixel circuit in accordance with a temperature.

SUMMARY OF THE INVENTION

The inventors of the present invention observed the ghost image more carefully than conventionally done. Then, it was found that the ghost image was sometimes generated even when the average of the potential of a positive-polarity signal and the potential of a negative-polarity signal applied to the data line was shifted from the common potential by a predetermined value (fixed optimal value).

The present invention has been made to solve the problem described above, and has an object to provide a liquid crystal display device which is capable of suppressing the generation of a ghost image as compared with the case where an average of a potential of a positive-polarity signal and a potential of a negative-polarity signal, which are applied to a data line, is shifted from a common potential by a predetermined value.

Representative aspects of the present invention disclosed in this application are briefly described as follows.

(1) A liquid crystal display device, including: a plurality of pixel circuits arranged in matrix; a plurality of data lines provided so as to correspond to rows of the plurality of pixel circuits; a plurality of scanning lines provided so as to correspond to columns of the plurality of pixel circuits; a data-line driving circuit for providing a signal to the plurality of data lines; and a scanning-line driving circuit for providing a scanning signal to the plurality of scanning lines, in which: each of the plurality of pixel circuits includes: a pixel capacitance having one end provided with a common potential; and a pixel transistor having a gate electrode provided with the scanning signal from one of the plurality of scanning lines, corresponding to the pixel circuit, and a source electrode and a drain electrode, one of the source electrode and the drain electrode being connected to another end of the pixel capacitance and another of the source electrode and the drain electrode being connected to one of the plurality of data lines, corresponding to the pixel circuit; the data-line driving circuit selectively outputs a positive-polarity signal and a negative-polarity signal to corresponding one of the plurality of data lines in accordance with a grayscale value for one of the plurality of pixel circuits; and the data-line driving circuit outputs the positive-polarity signal and the negative-polarity signal so that an average of a potential of the positive-polarity signal and a potential of the negative-polarity signal corresponding to the grayscale value changes in accordance with any one of the grayscale value, a temperature, a distance to the corresponding one of the plurality of pixel circuits from the scanning-line driving circuit, and a distance to the corresponding one of the plurality of pixel circuits from the data-line driving circuit.

(2) The liquid crystal display device according to the above-mentioned item (1), in which: the data-line driving circuit selectively outputs anyone of a combination of a positive-polarity precharge signal and an image signal subsequent to the positive-polarity precharge signal and a combination of a negative-polarity precharge signal and an image signal subsequent to the negative-polarity precharge signal to the corresponding one of the plurality of data lines in accordance with the grayscale value for the corresponding one of the plurality of pixel circuits; and the data-line driving circuit outputs the positive-polarity precharge signal and the negative-polarity precharge signal so that an average of a potential of the positive-polarity precharge signal and a potential of the negative-polarity precharge signal corresponding to the grayscale value changes in accordance with any one of the grayscale value, the temperature, the distance to the corresponding one of the plurality of pixel circuits from the scanning-line driving circuit, and the distance to the corresponding one of the plurality of pixel circuits from the data-line driving circuit.

(3) The liquid crystal display device according to the above-mentioned item (2), in which the data-line driving circuit outputs the positive-polarity precharge signal and the negative-polarity precharge signal so that the average of the potential of the positive-polarity precharge signal and the potential of the negative-polarity precharge signal corresponding to the grayscale value increases or decreases monotonously when the grayscale value increases from the smallest value to any one value within a range of the grayscale value or as the temperature decreases.

(4) The liquid crystal display device according to the above-mentioned item (2) or (3), in which: a potential of the image signal is determined in accordance with the grayscale value; and the data-line driving circuit outputs the precharge signals so that a potential difference between the potential of the precharge signal and the potential of the image signal, each signal having any one of the positive polarity and the negative polarity, corresponding to the grayscale value changes as the grayscale value increases until the grayscale value becomes equal to a change limit grayscale value corresponding to a grayscale value at which the potential difference becomes equal to a predetermined value and a change amount of the potential difference after the grayscale value exceeds the change limit grayscale value is smaller than before the grayscale value exceeds the change limit grayscale value.

(5) The liquid crystal display device according to the above-mentioned item (2) or (3), in which: a potential of the image signal is determined in accordance with the grayscale value; and the data-line driving circuit outputs the precharge signals so that a potential difference between the potential of the precharge signal and the potential of the image signal, each signal having any one of the positive polarity and the negative polarity, corresponding to the grayscale value changes as the distance to the corresponding one of the plurality of pixel circuits from the data-line driving circuit increases until the distance becomes equal to a border distance at which the potential difference becomes equal to a predetermined value and a change amount of the potential difference after the distance exceeds the border distance is smaller than before the distance exceeds the border distance.

(6) The liquid crystal display device according to the above-mentioned item (2) or (3), in which: a potential of the image signal is determined in accordance with the grayscale value; and the data-line driving circuit outputs the precharge signals so that a potential difference between the potential of the precharge signal and the potential of the image signal, each signal having any one of the positive polarity and the negative polarity, corresponding to the grayscale value changes as the distance to the corresponding one of the plurality of pixel circuits from the scanning-line driving circuit decreases until the distance becomes equal to a border distance at which the potential difference becomes equal to a predetermined value and a change amount of the potential difference after the distance becomes smaller than the border distance is smaller than before the distance becomes smaller than the border distance.

(7) The liquid crystal display device according to the above-mentioned item (2) or (3), in which: a potential of the image signal is determined in accordance with the grayscale value; and the data-line driving circuit outputs the precharge signals so that a potential difference between the potential of the precharge signal and the potential of the image signal, each signal having any one of the positive polarity and the negative polarity, corresponding to the grayscale value changes as the temperature decreases until the temperature becomes equal to a border temperature at which the potential difference becomes equal to a predetermined value and a change amount of the potential difference after the temperature becomes lower than the border temperature is smaller than before the temperature becomes lower than the border temperature.

(8) The liquid crystal display device according to any one of the above-mentioned items (2) to (7), in which the data-line driving circuit outputs the positive-polarity precharge signal and the negative-polarity precharge signal so that the average of the potential of the positive-polarity precharge signal and the potential of the negative-polarity precharge signal corresponding at least to the smallest grayscale value becomes equal to the common potential.

(9) The liquid crystal display device according to the above-mentioned item (8), in which: the data-line driving circuit selectively outputs the positive-polarity precharge signal and the negative-polarity precharge signal corresponding to the grayscale value and a previous grayscale value which is a grayscale value in a previous frame; and the data-line driving circuit outputs the positive-polarity precharge signal and the negative-polarity precharge signal so that the average of the potential of the positive-polarity precharge signal and the potential of the negative-polarity precharge signal becomes equal to the common potential at least when the previous grayscale value is smaller than the grayscale value.

According to the present invention, it is possible to suppress the generation of the ghost image as compared with the case where the average of the potential of the positive-polarity signal and the potential of the negative-polarity signal, which are applied to the data line, is shifted from the common potential by the predetermined value.

BRIEF DESCRIPTION OF THE DRAWINGS

In the accompanying drawings:

FIG. 6 shows an example of a lookup table which stores a correction amount for a positive-polarity image signal;

FIG. 7 shows an example of a lookup table which stores a correction amount for a negative-polarity image signal;

DETAILED DESCRIPTION OF THE INVENTION

Figure 1:
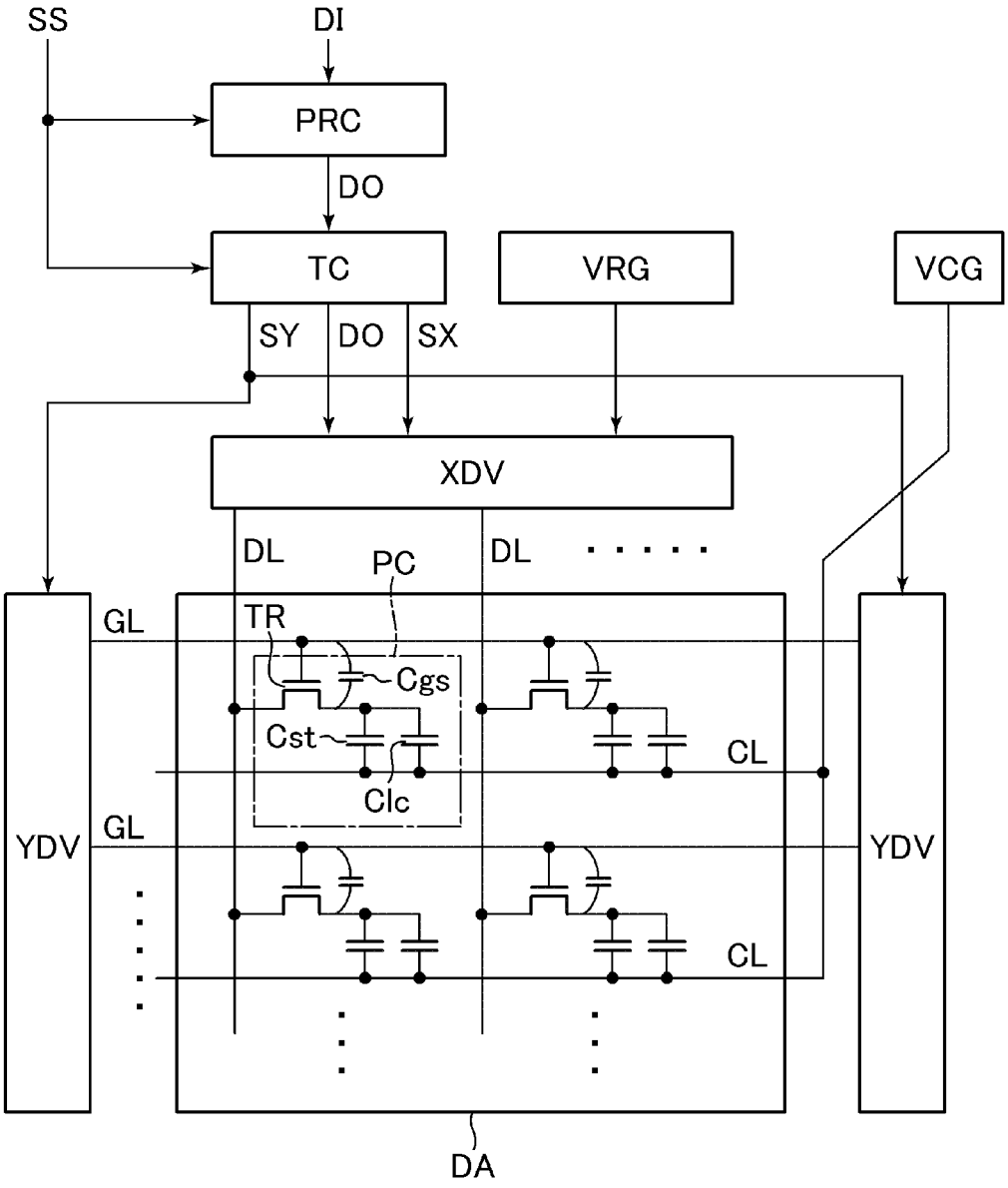
FIG. 1 is a diagram illustrating an example of a configuration of a liquid crystal display device according to an embodiment of the present invention.

Hereinafter, an embodiment of the present invention is described based on the accompanying drawings. The components having the same functions, which are described and illustrated in this specification, are denoted by the same reference character, and the description thereof is herein omitted.

A liquid crystal display device according to the embodiment of the present invention includes a liquid crystal display panel, a backlight unit for supplying light transmitting through the liquid crystal display panel, and a control board. In terms of a structure, the liquid crystal display panel includes an array substrate, a counter substrate, liquid crystal, and an integrated-circuit package. On the array substrate, pixel circuits PC are formed. The counter substrate is provided so as to be opposed to the array substrate. The liquid crystal is sealed between the array substrate and the counter substrate. The integrated-circuit package is provided on the array substrate. Polarizer plates are bonded onto the outer side of the array substrate and the outer side of the counter substrate. The liquid crystal display device according to this embodiment performs color display.

FIG. 1 is a diagram illustrating an example of a configuration of the liquid crystal display device according to the embodiment of the present invention. The liquid crystal display device according to this embodiment includes a display region DA having a rectangular shape, a precharge circuit PRC, a timing control circuit TC, a reference-potential providing circuit VRG, a common-potential providing circuit VCG, a scanning-line driving circuit YDV, a data-line driving circuit XDV, a plurality of scanning lines GL, a plurality of data lines DL, and common lines CL. The display region DA, the plurality of scanning lines GL, and the plurality of data lines DL are provided on the array substrate included in the liquid crystal display panel. In the display region DA, the plurality of pixel circuits PC are arranged in matrix. Two scanning-line driving circuits YDV are provided. One is for feeding a scanning signal from the right side of the display region DA of FIG. 1 (hereinafter, referred to as "right scanning-line driving circuit YDV"), and the other is for feeding a scanning signal from the left side (hereinafter, referred to as "left scanning-line driving circuit YDV"). A part of the right scanning-line driving circuit YDV is provided on the right of the display region DA on the array substrate and a part of the left scanning-line driving circuit YDV is provided on the left of the display region DA on the array substrate, whereas the remaining part of the scanning line driving circuits YDV is provided in the integrated-circuit package. A part of the data-line driving circuit XDV is provided in the upper part of the display region, whereas the remaining part of the data-line driving circuit XDV is provided in the integrated-circuit package. The precharge circuit PRC, the timing control circuit TC, the reference-potential providing circuit VRG, and the common-potential providing circuit VCG are provided on the control board.

The scanning lines GL are aligned in the display region DA so as to extend in a horizontal direction in FIG. 1. A right end of each of the scanning lines GL is connected to the right scanning-line driving circuit YDV, and a left end of each of the scanning lines GL is connected to the left scanning-line driving circuit YDV. The data lines DL are aligned in the display region DA so as to extend in a vertical direction in FIG. 1. An upper end of each of the data lines DL is connected to the data-line driving circuit XDV. Each of the pixel circuits PC is provided so as to correspond to a point of intersection of the data line DL and the scanning line GL. For color displaying, one pixel consists of three pixel circuits PC for displaying red, blue, and green, respectively. The three pixel circuits PC are arranged in the horizontal direction. When a resolution of a screen is 1,920 columns by 1,080 rows, the number of the pixel circuits PC provided in the display region DA is (1,920×3) columns by 1,080 rows. The number of the data lines DL is (1,920×3), whereas the number of scanning lines GL is 1,080. Each of the data lines DL corresponds to the column of the pixel circuits PC, and each of the scanning lines GL corresponds to the row of the pixel circuits PC. Each of the pixel circuits PC is connected to the corresponding data line DL. The pixel circuits PC constituting one column display the same color and are connected to one of the data lines DL.

Each of the pixel circuits PC includes a pixel transistor TR, a liquid-crystal capacitance Clc, and a wiring capacitance Cst. The liquid crystal capacitance Clc includes a pixel electrode, a common electrode, and liquid crystal interposed between the pixel electrode and the common electrode. The pixel transistor TR is an n-channel type thin-film transistor operating as a switch. A gate electrode of the pixel transistor TR is connected to the scanning line GL corresponding to the pixel circuit PC including the same pixel transistor TR. A source electrode of the pixel transistor TR is connected to the data line DL corresponding to the pixel circuit PC, whereas a drain electrode thereof is connected to the pixel electrode. The thin-film transistor has no polarity and therefore, the distinction between the source electrode and the drain electrode is made based on the potential applied thereto, for the sake of convenience. Although the destinations of connection of the source electrode and the drain electrode are described above for the sake of convenience, the destinations of connection may be interchanged with each other. The common electrode is electrically connected to the common line CL. Here, the wiring capacitance Cst other than the liquid-crystal capacitance Clc is formed between a node to which the pixel electrode is connected and the common line CL, and a parasitic capacitance Cgs of the pixel transistor TR is formed between a node to which the pixel electrode is connected and the scanning line GL.

The common-potential providing circuit VCG provides the common potential to the common line CL, and the reference-potential providing circuit VGR provides a plurality of reference potentials to be used by the data-line driving circuit XDV. The precharge circuit PRC outputs output data DO based on display grayscale data DI and an input synchronous signal SS input thereto. The timing control circuit TC inputs the output data DO output from the precharge circuit PRC to the data-line driving circuit XDV, and provides a horizontal synchronous signal SX to the data-line driving circuit XDV and a vertical synchronous signal SY to the scanning-line driving circuits YDV at timing in accordance with the input synchronous signal SS. A positive-polarity signal is a signal for setting a potential of the pixel electrode higher than a common potential, whereas a negative-polarity signal is a signal for setting the potential of the pixel electrode lower than the common potential. In the example of this embodiment, the positive polarity means that the potential of a signal or the like is higher than the common potential, whereas the negative polarity means that the potential of the signal or the like is lower than the common potential.

Figure 2:
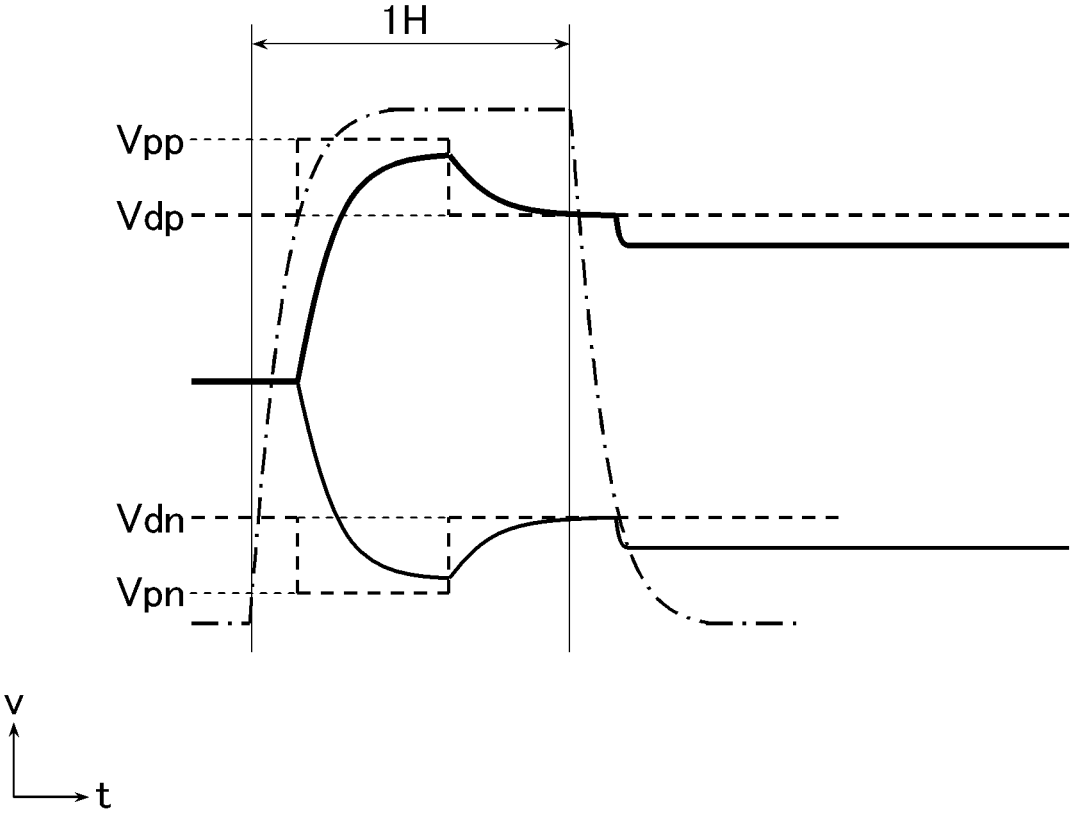
FIG. 2 is a waveform diagram illustrating an example of the relation between a potential of a precharge signal and a potential of an image signal.

In the liquid crystal display device, even when the potential is applied to the data line DL, it takes time for a potential of a source electrode of the pixel transistor TR included in the pixel circuit PC to reach the applied potential due to the parasitic capacitance formed between the data line DL and the scanning line GL. In order to bring the potential of the source electrode closer to a target potential within a horizontal interval 1H, the data-line driving circuit XDV applies, to the data line DL, a potential Vp of a precharge signal in a first half of the horizontal interval 1H and a potential Vd of an image signal in a second half of the horizontal interval 1H. FIG. 2 is a waveform diagram illustrating an example of the relation between the potential Vp of the precharge signal and the potential Vd of the image signal. A chain line indicates a waveform of the scanning signal applied by each of the scanning-line driving circuits YDV to the scanning line GL. Each of two broken lines indicates the potential of the signal applied by the data-line driving circuit XDV to the data line DL. Each of two solid lines indicates the potential of the pixel electrode. A time period from a rise of the potential of the scanning signal to a fall thereof corresponds to one horizontal interval 1H. In the example illustrated in FIG. 2, the waveforms in solid line and broken line for the increased potential within the horizontal interval 1H indicate the potential of the pixel electrode (solid line) and the potential applied to the data line DL (broken line) respectively in the case where the positive-polarity signal is applied. The waveforms in solid line and broken line for the reduced potential within the horizontal interval 1H indicate the potential of the pixel electrode (solid line) and the potential applied to the data line DL (broken line) respectively in the case where the negative-polarity signal is applied to the data line DL. The potential Vp of the precharge signal is a potential which is corrected so as to emphasize a difference between the potential Vd of the image signal applied to the data line DL for the pixel circuits PC of the previous row and the potential Vd of the image signal applied to the data line DL for the pixel circuits PC of the current row. Hereinafter, the potential Vd of the image signal is also referred to as grayscale potential. When the potential Vd of the image signal changes from a potential indicating a low-level grayscale to a potential indicating a high-level grayscale, the precharge signal has characteristics as follows. A potential Vpp of the positive-polarity precharge signal becomes higher than a potential Vdp of the positive-polarity image signal which is output subsequently to the positive-polarity precharge signal. And a potential Vpn of the negative-polarity precharge signal becomes lower than a potential Vdn of the negative-polarity image signal which is subsequently output to the negative-polarity precharge signal. When the potential Vd of the image signal changes from a potential indicating a high-level grayscale to a potential indicating a low-level grayscale, the precharge signal has characteristics as follows. A potential Vpp of the positive-polarity precharge signal becomes lower than a potential Vdp of the positive-polarity image signal which is output subsequently to the positive-polarity precharge signal. And the potential Vpn of the negative-polarity precharge signal becomes higher than the potential Vdn of the negative-polarity image signal which is output subsequently to the negative-polarity precharge signal.

Figure 3:
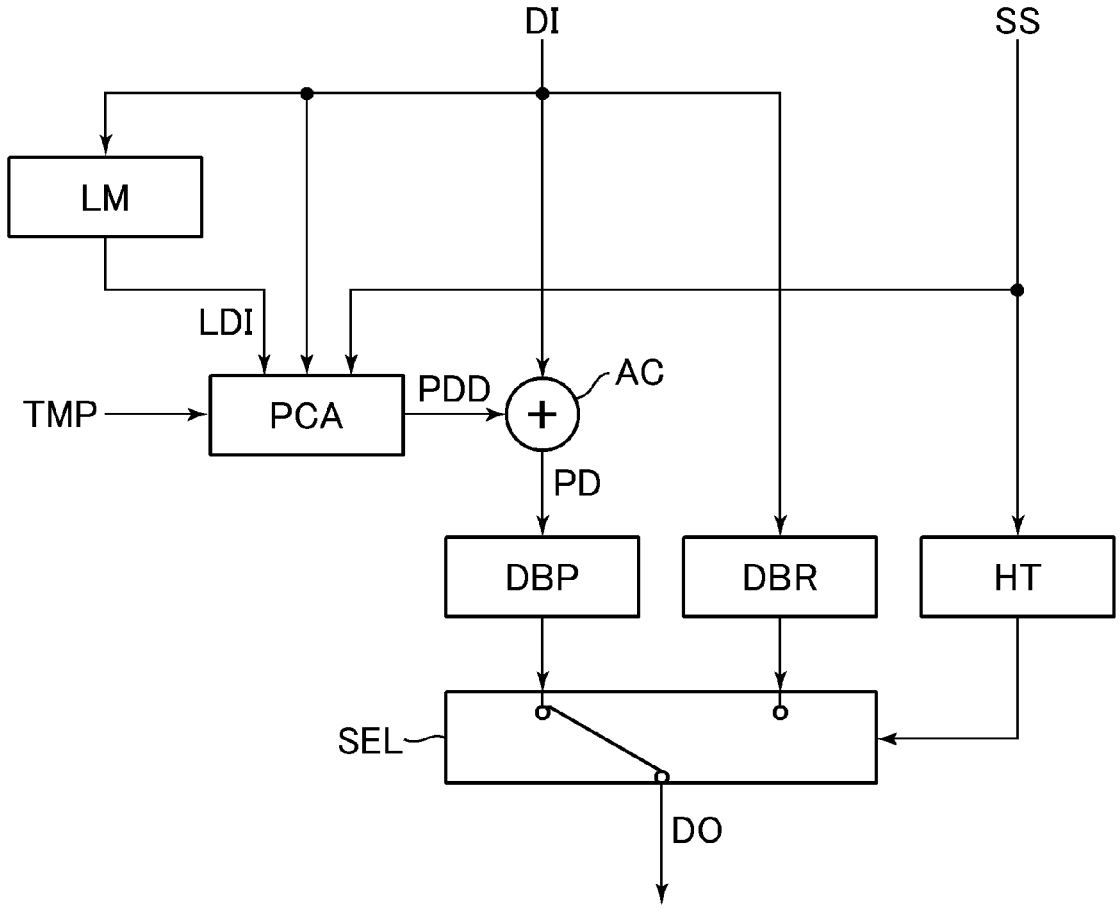
FIG. 3 is a diagram illustrating an example of a configuration of a precharge circuit.

FIG. 3 is a diagram illustrating an example of a configuration of the precharge circuit PRC. The precharge circuit PRC determines the potential Vp of the precharge signal so as to control the data-line driving circuit XDV to output the potential Vp of the precharge signal and the potential Vd of the image signal. The precharge circuit PRC includes a line memory LM, a correction-amount calculating circuit PCA, a double-speed converting circuit DBP for the precharge signal, a double-speed converting circuit DBR for the image signal, a horizontal counter HT, and a selector SEL. The line memory LM stores the display grayscale data DI for one row and outputs the stored data at timing at which subsequent display grayscale data DI is input. In other words, the line memory LM outputs the previous display grayscale data LDI corresponding to the display grayscale data DI of the preceding row. The correction-amount calculating circuit PCA calculates a value indicating a difference between the potential Vd of the image signal and the potential Vp of the precharge signal as correction-amount data PDD based on the display grayscale data DI, the previous display grayscale data LDI, the input synchronous signal SS, and a temperature signal TMP and outputs the calculated correction-amount data PDD to an adder circuit AC. The adder circuit AC adds a value of the display grayscale data DI and a value of the correction-amount data PDD to obtain a grayscale value indicating the potential Vp of the precharge signal as precharge data PD. The horizontal counter HT outputs a signal having potentials switched for each half period of the horizontal interval 1H based on a clock and the horizontal synchronous signal SX contained in the input synchronous signal SS. The selector SEL consecutively outputs the precharge data PD and the display grayscale data DI for a given row of the pixel circuits PC within one horizontal period in accordance with the signal output from the horizontal counter HT. The double-speed converting circuit DBP adjusts output timing of the precharge data PD so that the selector SEL outputs the precharge data PD within the half period of one horizontal interval. The double-speed converting circuit DBR adjusts output timing of the display grayscale data DI so that the selector SEL outputs the display grayscale data DI within the half period of one horizontal interval after the output of the precharge data PD.

The data-line driving circuit XDV outputs the potential indicated by the value of the precharge data PD as the precharge signal in the first half of one horizontal interval and outputs the potential indicated by the value of the display grayscale data DI as the image signal in the second half.

Figure 4:
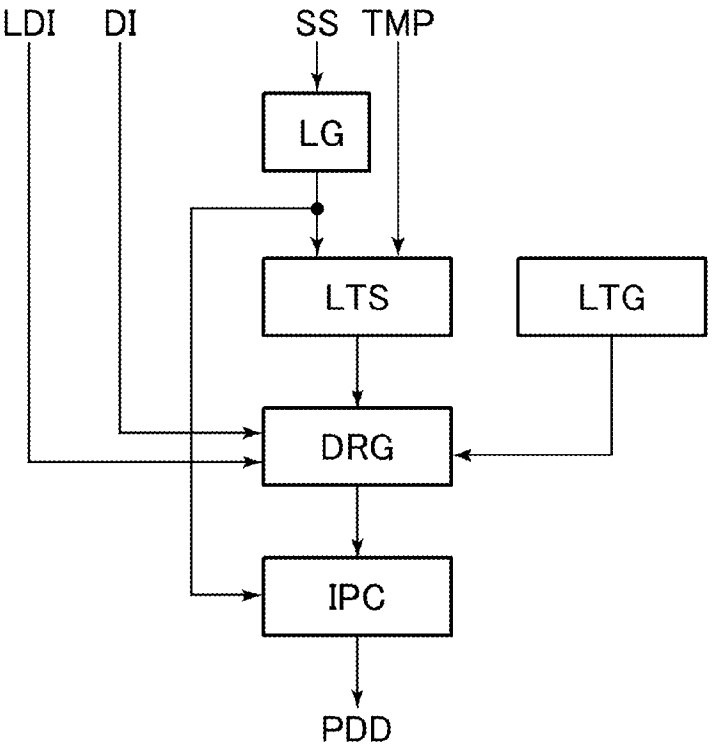
FIG. 4 is a diagram illustrating an example of a configuration of a correction-amount calculating circuit.

FIG. 4 is a diagram illustrating an example of a configuration of the correction-amount calculating circuit PCA. The correction-amount calculating circuit PCA includes a positional-information acquiring section LG, a lookup-table selecting section LTS, a lookup-table storing section LTG, a representative correction-amount calculating section DRG, and an interpolation processing section IPC. The correction-amount calculating circuit PCA calculates a correction amount in accordance with the grayscale value indicated by the display grayscale data DI, the temperature, the image signal, and the position of the pixel circuit PC corresponding to a target to be fed with the precharge signal. The lookup-table storing section LTG stores a plurality of lookup tables.

Figure 5:
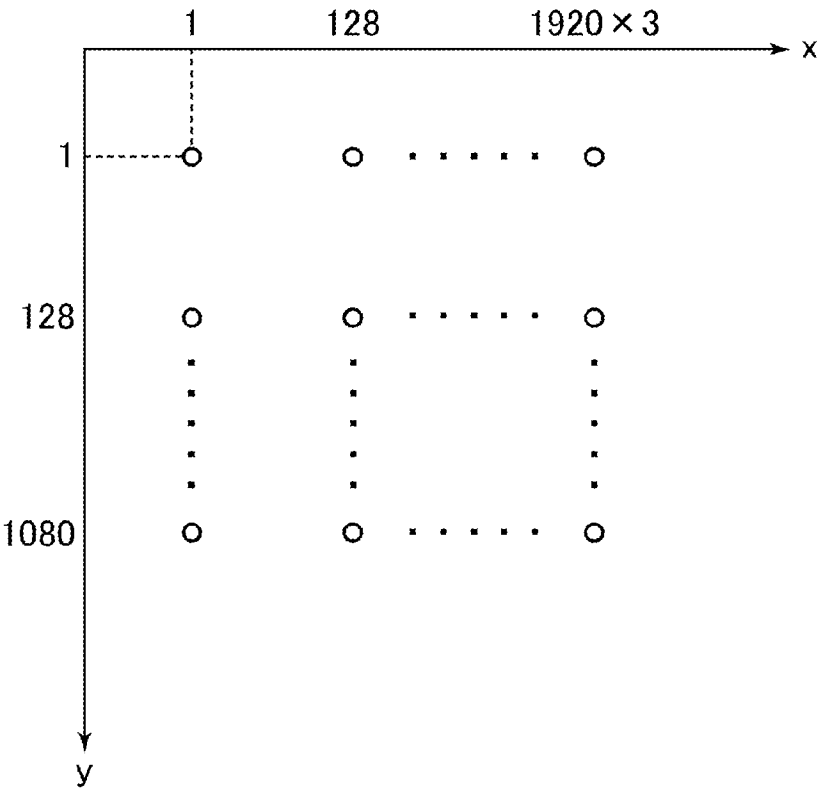
FIG. 5 is a graph illustrating an example of the relation between a lookup table and the position of a pixel circuit PC.

For each of the lookup tables, information for obtaining the correction amount for each combination of the grayscale value of the display grayscale data DI and the grayscale value of the previous display grayscale data LDI is set. The different lookup tables are prepared depending on T types of temperature condition, M types of column condition, N types of row condition, and conditions of the polarity of the image signal. The number of the lookup tables which are present is equal to the number of combinations of the aforementioned conditions. Therefore, a total number of lookup tables is ($T \times M \times N \times 2$). The M columns corresponding to the M types of the column condition are a part of all the columns of the pixel circuits PC and are referred to as representative columns. The N rows corresponding to the N types of the row condition are a part of all the rows of the pixel circuits PC and are referred to as representative rows. FIG. 5 is a graph illustrating an example of the relation between the lookup table and the position of the pixel circuit PC. The representative columns include a column on the smallest column coordinate x (on the right end of FIG. 5) and a row on the largest column coordinate x (on the left end of FIG. 5), whereas the representative rows include a row on the smallest row coordinate y (on the upper end of FIG. 5) and a row on the largest row coordinate y (on the lower end of FIG. 5). Here, the column coordinate indicates the order of the column of the pixel circuits PC from the upper side, whereas the row coordinate indicates the order of the row of the pixel circuits PC from the left. In this embodiment, the polarity of the potential applied to one data line DL does not change in a given frame period. Therefore, the polarity of the potential applied to the preceding row and the polarity of the potential applied to the current row are the same. Therefore, the conditions for the polarity are classified into two, that is, the case where the polarity of the image signal for the preceding row and the polarity of the image signal for the current row are positive and the case where the polarity of the image signal for the preceding row and the polarity of the image signal for the current row are negative.

More specifically, each of the lookup tables is a set of correction-amount data for each of the combinations of some representative values of the grayscale value of the display grayscale data DI and some representative values of the grayscale value of the previous display grayscale data LDI.

The positional-information acquiring section LG generates positional information in accordance with the input display grayscale data DI based on the input synchronous signal SS. The positional information indicates the position of the pixel circuit PC which is fed with the image signal The positional-information acquiring section LG also outputs polarity information indicating which of positive polarity or negative polarity the signal fed to the pixel circuit PC has.

The lookup table selecting section LTS selects a lookup table to be used for calculating the correction amount based on the positional information, the polarity information, and temperature information. The lookup table selecting section LTS first acquires a temperature condition which is the closest to the temperature indicated by the temperature signal TMP. Next, the lookup table selecting section LTS acquires one representative column on the same column coordinate x indicated by the positional information or two representative columns which are the closest thereto, and acquires one representative row on the same row coordinate y indicated by the positional information or two representative rows which are the closest thereto. Next, the lookup table selecting section LTS selects a lookup table(s) corresponding to the combination of the representative column(s) and the representative row(s) described above from the lookup tables satisfying the acquired polarity information and temperature condition. The number of lookup tables selected by the lookup table selecting section LTS is 1 to 4.

The representative correction-amount calculating section DRG uses the lookup table(s) selected by the lookup table selecting section LTS to calculate the correction amount for each of the selected lookup table(s). The interpolation processing section IPC performs interpolation processing based on the correction amount obtained for each of the selected lookup table(s), the representative column (s) and the representative row (s) corresponding to the lookup table(s), and the positional information in order to obtain the correction amount on the column coordinate x and the row coordinate y indicated by the positional information. The interpolation processing section IPC outputs the obtained correction amount as the correction-amount data PDD.

The contents which are set in the lookup tables are now described. FIG. 6 is a table showing an example of a lookup table which stores the correction amount for the positive-polarity image signal. FIG. 7 is a table showing an example of a lookup table which stores the correction amount for the negative-polarity image signal. In the example of FIGS. 6 and 7, eight representative values of the grayscale value, that is, 0, 32, 64, 96, 128, 160, 192, 224, and 255 are set. In FIGS. 6 and 7, there are some blank fields in which the value of the correction amount is not set for the combination of the display grayscale data DI and the previous display grayscale data LDI. Actually, however, values are set in the blank fields. The representative correction-amount calculating section DRG obtains, by the interpolation, the correction amount for the combination of the display grayscale data DI and the previous display grayscale data LDI for which the correction amount is not stored.

Figures 8, 9:
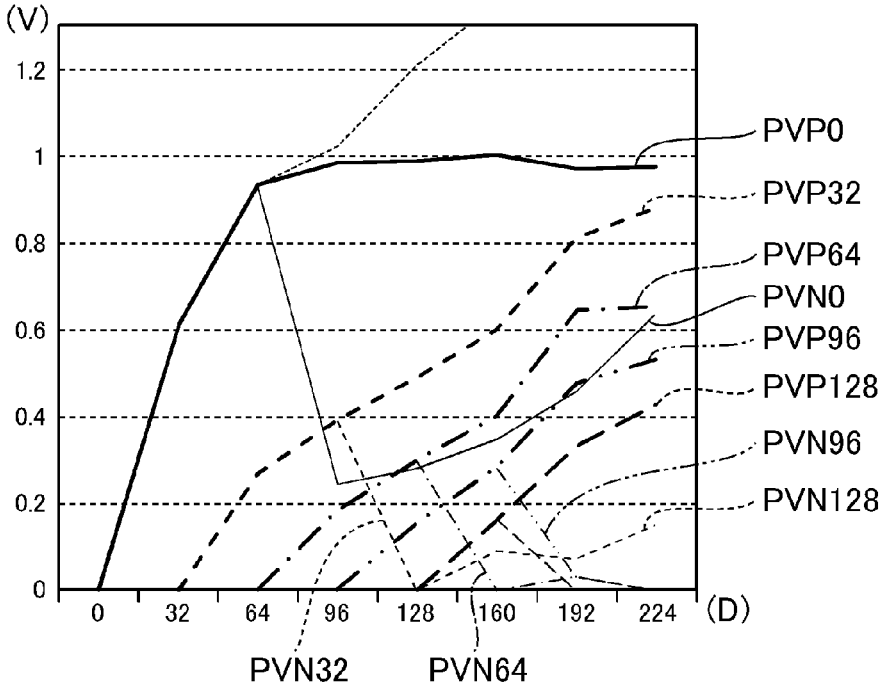
FIG. 8 is a graph illustrating an example of the relation between display grayscale data and a precharge correction amount.
FIG. 9 is a table showing an example of presence/absence of a difference between a positive-polarity precharge correction amount and a negative-polarity precharge correction amount for the combination of the display grayscale data and the previous display grayscale data.

Here, in this embodiment, for realizing display with the grayscale closest to that perceived by a human, the amount of change in potential when the grayscale value is changed by one differs in accordance with the grayscale value before being changed. Therefore, the magnitude relation between the values in the cells in the tables of FIGS. 6 and 7 is sometimes different from that of the potential of the precharge signal and the potential of the image signal. FIG. 8 is a graph illustrating an example of the relation between the display grayscale data DI and a precharge correction amount V. A horizontal axis of FIG. 8 indicates the grayscale value of the display grayscale data DI, whereas a vertical axis indicates the precharge correction amount V. The precharge correction amount V indicates a difference between the potential of the positive-polarity precharge signal and the potential of the positive-polarity image signal or a difference between the potential of the negative-polarity image signal and the potential of the negative-polarity precharge signal. FIG. 8 illustrates the precharge correction amount for the positive-polarity image signal (thick line; hereinafter, referred to as positive-polarity precharge correction amount) and the precharge correction amount for the negative-polarity image signal (thin line; hereinafter, referred to as negative-polarity precharge correction amount) at a given temperature. A line denoted by PVPs (s is 0, 32, 64, 96, or 128) illustrated in FIG. 8 indicates the positive-polarity precharge correction amount V when the grayscale value of the previous display grayscale data LDI is s, and a line denoted by PVNs illustrated in FIG. 8 indicates the negative-polarity precharge correction amount V when the grayscale value of the previous display grayscale data LDI is s.

First, as can be seen from the case where the grayscale value of the previous display grayscale data LDI is the smallest (0), at least in the case where the grayscale value of the display grayscale data DI is the smallest, the positive-polarity precharge correction amount V and the negative-polarity precharge correction amount V are the same. This fact shows that the potential of the positive-polarity precharge signal and the potential of the negative-polarity precharge signal are symmetric with respect to the common potential. Therefore, in this case, an average of the potential of the positive-polarity precharge signal and the potential of the negative-polarity precharge signal, which are corrected with the precharge correction amounts, becomes equal to the common potential. Even if the grayscale value of the display grayscale data DI increases from the smallest grayscale value, the positive-polarity precharge correction amount and the negative-polarity precharge correction amount are the same when the grayscale value increases from the smallest grayscale value described above to any one of the values within the range of the grayscale value. FIG. 9 is a table showing an example of presence/absence of a difference between the positive-polarity precharge correction amount and the negative-polarity precharge correction amount for the combination of the display grayscale data DI and the previous display grayscale data LDI. A circle shown in FIG. 9 means that the negative-polarity precharge correction amount and the positive-polarity precharge correction amount are equal to each other, a triangle means that the negative-polarity precharge correction amount and the positive-polarity precharge correction amount become different after the grayscale value of the display grayscale data DI exceeds the grayscale value indicated by the cell, and a cross means that the positive-polarity precharge correction amount is larger than the negative-polarity precharge correction amount. At least when the grayscale value of the previous display grayscale data LDI is smaller than the grayscale value of the display grayscale data DI, the positive-polarity precharge correction amount and the negative-polarity precharge correction amount are the same. Even in the case where the grayscale value of the previous display grayscale data LDI is larger than the grayscale value of the display grayscale data DI, and where the grayscale of the previous display grayscale data LDI is low to some extent, the positive-polarity precharge correction amount and the negative-polarity precharge correction amount become equal to each other until the grayscale value becomes equal to a change limit grayscale value which is determined in accordance with the previous display grayscale data LDI, the temperature, and the position of each display grayscale data.

When the positive-polarity precharge correction amount and the negative-polarity precharge correction amount are different from each other, the positive-polarity precharge correction amount is larger than the negative-polarity precharge correction amount. This fact shows that the average of the potential of the positive-polarity precharge signal and the potential of the negative-polarity precharge signal is higher than the common potential. Each of the pixel transistors TR is an n-channel type thin-film transistor. For turning ON the pixel transistor TR, a potential higher than the common potential and the largest potential of the positive-polarity image signal is fed to the scanning line GL. Comparing the case where the positive-polarity signal is applied to the source electrode of the pixel transistor TR and the case where the negative-polarity signal is applied thereto, a current more easily flows with the negative-polarity signal than with the positive-polarity signal because of a different potential difference between the source and a gate. Therefore, if the average of the positive-polarity signal and the negative-polarity signal becomes equal to the common potential, the average of the potential of the positive-polarity signal and the potential of the negative-polarity signal, which are applied to the pixel electrode, deviates from the common potential. Moreover, as the difference between the potential of the positive-polarity signal and the potential of the negative-polarity signal becomes larger, the amount of deviation becomes larger. Except for the case where, for example, the grayscale value of the previous display grayscale data LDI is 0 and a limit described below is provided, the correction amount is set in the lookup table so that the difference between the positive-polarity precharge correction amount and the negative-polarity precharge correction amount increases monotonously with an increase in the grayscale value of the display grayscale data DI. In this embodiment, the average of the potential of the positive-polarity precharge signal and the negative-polarity precharge signal is adjusted in accordance with the display grayscale data DI indicating the potential of the image signal. Therefore, the generation of a ghost image due to a change in potential of the signal can be suppressed.

Further, assuming that the grayscale value of the previous display grayscale data LDI is constant, the positive-polarity precharge correction amount increases monotonously as the grayscale value of the grayscale data DI increases from the smallest value. However, instead of increasing in a simple manner, the precharge correction amount V increases as the grayscale value increases until the grayscale value becomes equal to the grayscale value (change limit grayscale value) at which it is determined that the precharge correction amount V becomes equal to a predetermined amount (1 V in the case of FIG. 9) and does not exceed the predetermined positive-polarity precharge correction amount even if the grayscale value further increases from the change limit grayscale value. Seeing the positive-polarity precharge correction amount when the value of the previous display grayscale data LDI is 0 in FIG. 8, it is understood that the aforementioned limit is provided. Here, the correction amount stored in the lookup table is a discrete digital value. In a strict sense, the change limit grayscale value is a grayscale value at which the precharge correction amount indicated by the digital value thereof becomes an approximate value for the predetermined amount. For the grayscale value equal to or larger than the change limit grayscale value, the precharge correction amount indicated by the digital value of the correction amount is the approximate value for the predetermined value. For the grayscale value equal to or larger than the change limit grayscale value, an error from the predetermined value is only about a potential difference for one-level grayscale. Therefore, a change in the precharge correction amount is smaller as compared with that for a grayscale value smaller than the change limit grayscale value.

According to an experiment conducted by the inventors of the present invention, when the positive-polarity precharge correction amount becomes larger than the predetermined amount, a variation occurs in the potential that the potential of the pixel electrode reaches due to the positive-polarity image signal. Therefore, the average of the potential of the pixel electrode which is reached due to the positive-polarity image signal and the potential of the pixel electrode which is reached due to the negative-polarity image signal deviates from the common potential, sometimes resulting in the generation of a ghost image. In this embodiment, by providing the limit as described above, the generation of the ghost image due to the variation can be suppressed.

Figure 10:
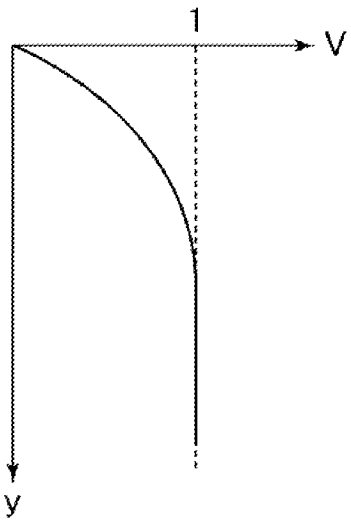
FIG. 10 is a graph illustrating an example of the relation between a row coordinate and the positive-polarity precharge correction amount.

FIG. 10 is a graph illustrating an example of the relation between the row coordinate y and the positive-polarity precharge correction amount V. FIG. 10 is a graph for the case where the grayscale value of the previous display grayscale data LDI, the grayscale value of the display grayscale data DI, the temperature, and the column coordinate x are fixed. As a length of the data line DL between the data-line driving circuit XDV and the pixel circuit PC becomes longer (a distance therebetween becomes larger), the precharge correction amount becomes larger. In this manner, a difference in characteristics due to the length of the data line DL is dealt with. On the other hand, when the precharge correction amount V exceeds the predetermined amount as described above, the ghost image is sometimes generated thereby. Therefore, until the distance becomes equal to a distance (change limit row distance) at which the precharge correction amount V becomes equal to the predetermined amount, the precharge correction amount V increases as the distance increases. Then, even if the distance further increases to exceed the change limit row distance, the positive-polarity precharge correction amount does not exceed the predetermined amount. As in the case where the grayscale value increases, the precharge correction amount indicated by the digital value of the correction amount becomes the approximate value for the predetermined value with the distance equal to or larger than the change limit row distance.

Figure 11:
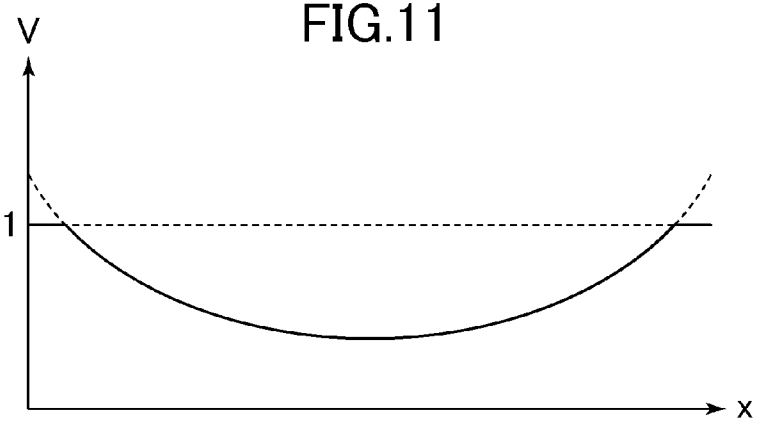
FIG. 11 is a graph illustrating an example of the relation between a column coordinate and the positive-polarity precharge correction amount.

FIG. 11 is a graph illustrating an example of the relation between the column coordinate x and the positive-polarity precharge correction amount V. FIG. 11 is a graph for the case where the grayscale value of the previous display grayscale data LDI, the grayscale value of the display grayscale data DI, the temperature, and the row coordinate y are fixed. As a length of the scanning line GL between the scanning-line driving circuit YDV and the pixel circuit PC becomes longer (a distance therebetween becomes larger), the precharge correction amount becomes smaller. In this manner, the problem which relates to the length of the scanning line GL is eased. The change of the potential under the effects of the scanning signal is slower as the length of the scanning line GL becomes shorter. On the other hand, as described above, when the precharge correction amount exceeds the predetermined amount, the ghost image is sometimes generated thereby. Therefore, after the distance is increased or reduced from the position corresponding to the center to a distance (change limit column distance) at which the precharge correction amount becomes equal to the predetermined amount, the positive-polarity precharge correction amount does not exceed the predetermined amount even if the distance exceeds the change limit column distance. As in the case where the grayscale value increases, the precharge correction amount indicated by the digital value of the correction amount becomes the approximate value for the predetermined value with the distance larger than the change limit column distance. When the positive-polarity precharge correction amount changes in accordance with the distance as in the examples illustrated in FIGS. 10 and 11, the difference between the negative-polarity precharge correction amount and the positive-polarity precharge correction amount also changes. The correction amounts are stored in the plurality of lookup tables so as to satisfy the conditions described above referring to FIGS. 10 and 11. The lookup table may be set so that the precharge correction amount does not change in accordance with the column coordinate x as illustrated in FIG. 11.

Figure 12:
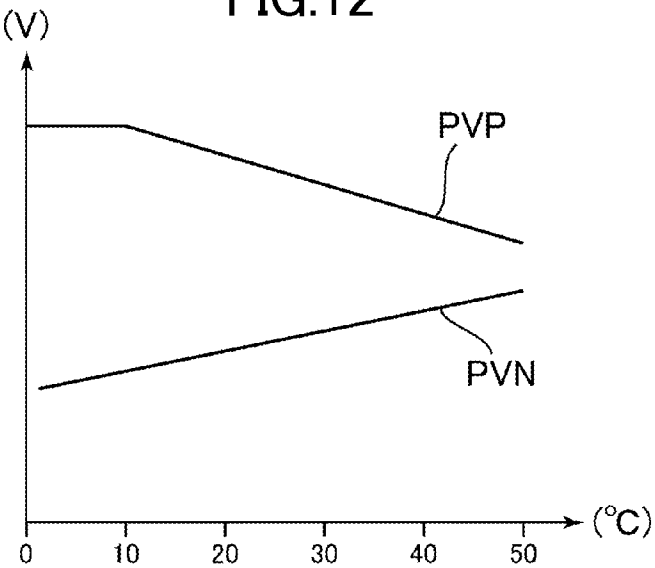
FIG. 12 is a graph illustrating an example of the relation between a temperature and the precharge correction amount.

FIG. 12 is a graph illustrating an example of the relation between the temperature and the precharge correction amount V. FIG. 12 is a graph for the case where the grayscale value of the previous display grayscale data LDI, the grayscale value of the display grayscale data DI, the row coordinate y, and the column coordinate x are fixed. As the temperature decreases, the difference between the positive-polarity precharge correction amount and the negative-polarity precharge correction amount increases monotonously. Moreover, the limit is provided on the positive-polarity precharge correction amount. Therefore, the precharge correction amount increases as the temperature decreases until the temperature becomes equal to a temperature (change limit temperature) at which the precharge correction amount becomes equal to the predetermined amount. Then, even if the temperature decreases to be lower than the change limit temperature, the positive-polarity precharge correction amount does not exceed the predetermined amount. In this manner, the generation of the ghost image due to a change in characteristics of the pixel circuit PC, caused by the temperature, can be suppressed.

The pixel transistor TR may be a p-channel type thin-film transistor. In this case, the polarity of the scanning signal fed to the scanning line GL is inverted. Therefore, the current more easily flows with the positive-polarity signal than with the negative-polarity signal. A direction in which the common potential deviates becomes opposite. Therefore, the direction of correction also becomes opposite. For example, when the grayscale value of the display grayscale data DI increases from the smallest value to any one of the values within the range of the grayscale value, the difference between the positive-polarity precharge correction amount and the negative-polarity precharge correction amount decreases monotonously. As the temperature decreases, the difference decreases monotonously. Moreover, the positive-polarity precharge correction amount and the negative-polarity precharge correction amount are set in accordance with the grayscale value, the temperature, and the position of the pixel circuit PC so that the negative-polarity precharge correction amount does not exceed the predetermined amount.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising:

a plurality of pixel circuits arranged in a matrix;

a plurality of data lines provided so as to correspond to rows of the plurality of pixel circuits;

a plurality of scanning lines provided so as to correspond to columns of the plurality of pixel circuits;

a data-line driving circuit for providing a signal to the plurality of data lines; and a scanning-line driving circuit for providing a scanning signal to the plurality of scanning lines, wherein:

each of the plurality of pixel circuits comprises:

a pixel capacitance having one end provided with a common potential; and a pixel transistor having a gate electrode provided with the scanning signal from one of the plurality of scanning lines, corresponding to the pixel circuit, and a source electrode and a drain electrode, one of the source electrode and the drain electrode being connected to another end of the pixel capacitance and another of the source electrode and the drain electrode being connected to one of the plurality of data lines, corresponding to the pixel circuit;

the data-line driving circuit selectively outputs any one of a combination of a positive-polarity precharge signal and an image signal subsequent to the positive-polarity precharge signal and a combination of a negative-polarity precharge signal and an image signal subsequent to the negative-polarity precharge signal to the corresponding one of the plurality of data lines in accordance with a grayscale value for the corresponding one of the plurality of pixel circuits;

the data-line driving circuit outputs the positive-polarity precharge signal and the negative-polarity precharge signal so that an average of a potential of the positive-polarity precharge signal and a potential of the negative-polarity precharge signal corresponding to the grayscale value changes in accordance with any one of the grayscale value, temperature, a distance to the corresponding one of the plurality of pixel circuits from the scanning-line driving circuit, and a distance to corresponding the one of the plurality of pixel circuits from the data-line driving circuit;

a potential of the image signal is determined in accordance with the grayscale value; and the data-line driving circuit outputs the precharge signals so that a potential difference between the potential of the precharge signal and the potential of the image signal, each signal having any one of the positive polarity and the negative polarity, corresponding to the gradation value changes as the grayscale value increases until the grayscale value becomes equal to a change limit grayscale value corresponding to a grayscale value at which the potential difference becomes equal to a predetermined value and a change amount of the potential difference after the grayscale value exceeds the change limit grayscale value is smaller than before the grayscale value exceeds the change limit grayscale value.

2. A liquid crystal display device, comprising:

a plurality of pixel circuits arranged in a matrix;

a plurality of data lines provided so as to correspond to rows of the plurality of pixel circuits;

a plurality of scanning lines provided so as to correspond to columns of the plurality of pixel circuits;

a data-line driving circuit for providing a signal to the plurality of data lines; and a scanning-line driving circuit for providing a scanning signal to the plurality of scanning lines, wherein:

each of the plurality of pixel circuits comprises:

a pixel capacitance having one end provided with a common potential; and a pixel transistor having a gate electrode provided with the scanning signal from one of the plurality of scanning lines, corresponding to the pixel circuit, and a source electrode and a drain electrode, one of the source electrode and the drain electrode being connected to another end of the pixel capacitance and another of the source electrode and the drain electrode being connected to one of the plurality of data lines, corresponding to the pixel circuit;

the data-line driving circuit selectively outputs any one of a combination of a positive-polarity precharge signal and an image signal subsequent to the positive-polarity precharge signal and a combination of a negative polarity precharge signal and an image signal subsequent to the negative-polarity precharge signal to the corresponding one of the plurality of data lines in accordance with a grayscale value for the corresponding one of the plurality of pixel circuits;

the data-line driving circuit outputs the positive-polarity precharge signal and the negative-polarity precharge signal so that an average of a potential of the positive-polarity precharge signal and a potential of the negative-polarity precharge signal corresponding to the grayscale value changes in accordance with any one of the grayscale value, temperature, a distance to the corresponding one of the plurality of pixel circuits from the scanning-line driving circuit, and a distance to the corresponding one of the plurality of pixel circuits from the data-line driving circuit;

a potential of the image signal is determined in accordance with the grayscale value; and the data-line driving circuit outputs the precharge signals so that a potential difference between the potential of the precharge signal and the potential of the image signal, each signal having any one of the positive polarity and the negative polarity, corresponding to the gradation value changes as the distance to the corresponding one of the plurality of pixel circuits from the data-line driving circuit increases until the distance becomes equal to a border distance at which the potential difference becomes equal to a predetermined value and a change amount of the potential difference after the distance exceeds the border distance is smaller than before the distance exceeds the border distance.

3. A liquid crystal display device, comprising:

a plurality of pixel circuits arranged in a matrix;

a plurality of data lines provided so as to correspond to rows of the plurality of pixel circuits;

a plurality of scanning lines provided so as to correspond to columns of the plurality of pixel circuits;

a data-line driving circuit for providing a signal to the plurality of data lines; and a scanning-line driving circuit for providing a scanning signal to the plurality of scanning lines, wherein:

each of the plurality of pixel circuits comprises:

a pixel capacitance having one end provided with a common potential; and a pixel transistor having a gate electrode provided with the scanning signal from one of the plurality of scanning lines, corresponding to the pixel circuit, and a source electrode and a drain electrode, one of the source electrode and the drain electrode being connected to another end of the pixel capacitance and another of the source electrode and the drain electrode being connected to one of the plurality of data lines, corresponding to the pixel circuit;

the data-line driving circuit selectively outputs any one of a combination of a positive-polarity precharge signal and an image signal subsequent to the positive-polarity precharge signal and a combination of a negative-polarity precharge signal and an image signal subsequent to the negative-polarity precharge signal to the corresponding one of the plurality of data lines in accordance with a grayscale value for the corresponding one of the plurality of pixel circuits;

the data-line driving circuit outputs the positive-polarity precharge signal and the negative-polarity precharge signal so that an average of a potential of the positive-polarity precharge signal and a potential of the negative-polarity precharge signal corresponding to the grayscale value changes in accordance with any one of the grayscale value, temperature, a distance to the corresponding one of the plurality of pixel circuits from the scanning-line driving circuit, and a distance to the corresponding one of the plurality of pixel circuits from the data-line driving circuit;

a potential of the image signal is determined in accordance with the grayscale value; and the data-line driving circuit outputs the precharge signals so that a potential difference between the potential of the precharge signal and the potential of the image signal, each signal having any one of the positive polarity and the negative polarity, corresponding to the grayscale value changes as the distance to the corresponding one of the plurality of pixel circuits from the scanning-line driving circuit decreases until the distance becomes equal to a border distance at which the potential difference becomes equal to a predetermined value and a change amount of the potential difference after the distance becomes smaller than the border distance is smaller than before the distance becomes smaller than the border distance.

4. A liquid crystal display device, comprising:

a plurality of pixel circuits arranged in a matrix;

a plurality of data lines provided so as to correspond to rows of the plurality of pixel circuits;

a plurality of scanning lines provided so as to correspond to columns of the plurality of pixel circuits;

a data-line driving circuit for providing a signal to the plurality of data lines; and a scanning-line driving circuit for providing a scanning signal to the plurality of scanning lines, wherein:

each of the plurality of pixel circuits comprises:

a pixel capacitance having one end provided with a common potential; and a pixel transistor having a gate electrode provided with the scanning signal from one of the plurality of scanning lines, corresponding to the pixel circuit, and a source electrode and a drain electrode, one of the source electrode and the drain electrode being connected to another end of the pixel capacitance and another of the source electrode and the drain electrode being connected to one of the plurality of data lines, corresponding to the pixel circuit;

the data-line driving circuit selectively outputs any one of a combination of a positive-polarity precharge signal and an image signal subsequent to the positive-polarity precharge signal and a combination of a negative-polarity precharge signal and an image signal subsequent to the negative-polarity precharge signal to the corresponding one of the plurality of data lines in accordance with a grayscale value for the corresponding one of the plurality of pixel circuits;

the data-line driving circuit outputs the positive-polarity precharge signal and the negative-polarity precharge signal so that an average of a potential of the positive-polarity precharge signal and a potential of the negative-polarity precharge signal corresponding to the grayscale value changes in accordance with any one of the grayscale value, temperature, a distance to the corresponding one of the plurality of pixel circuits from the scanning-line driving circuit, and a distance to the corresponding one of the plurality of pixel circuits from the data-line driving circuit;

a potential of the image signal is determined in accordance with the grayscale value; and the data-line driving circuit outputs the precharge signals so that a potential difference between the potential of the precharge signal and the potential of the image signal, each signal having any one of the positive polarity and the negative polarity, corresponding to the grayscale value changes as the temperature decreases until the temperature becomes equal to a border temperature at which the potential difference becomes equal to a predetermined value and a change amount of the potential difference after the temperature becomes lower than the border temperature is smaller than before the temperature becomes lower than the border temperature.

5. A liquid crystal display device, comprising:

a plurality of pixel circuits arranged in a matrix;

a plurality of data lines provided so as to correspond to rows of the plurality of pixel circuits;

a plurality of scanning lines provided so as to correspond to columns of the plurality of pixel circuits;

a data-line driving circuit for providing a signal to the plurality of data lines; and a scanning-line driving circuit for providing a scanning signal to the plurality of scanning lines, wherein:

each of the plurality of pixel circuits comprises:

a pixel capacitance having one end provided with a common potential; and a pixel transistor having a gate electrode provided with the scanning signal from one of the plurality of scanning lines, corresponding to the pixel circuit, and a source electrode and a drain electrode, one of the source electrode and the drain electrode being connected to another end of the pixel capacitance and another of the source electrode and the drain electrode being connected to one of the plurality of data lines, corresponding to the pixel circuit;

the data-line driving circuit selectively outputs any one of a combination of a positive-polarity precharge signal and an image signal subsequent to the positive-polarity precharge signal and a combination of a negative-polarity precharge signal and an image signal subsequent to the negative-polarity precharge signal to the corresponding one of the plurality of data lines in accordance with a grayscale value for the corresponding one of the plurality of pixel circuits;

the data-line driving circuit outputs the positive-polarity precharge signal and the negative-polarity precharge signal so that an average of a potential of the positive-polarity precharge signal and a potential of the negative-polarity precharge signal corresponding to the grayscale value changes in accordance with any one of the grayscale value, temperature, a distance to the corresponding one of the plurality of pixel circuits from the scanning-line driving circuit, and a distance to the corresponding one of the plurality of pixel circuits from the data-line driving circuit;

the data-line driving circuit outputs the positive-polarity precharge signal and the negative-polarity precharge signal so that the average of the potential of the positive-polarity precharge signal and the potential of the negative-polarity precharge signal corresponding at least to the smallest grayscale value becomes equal to the common potential.

6. The liquid crystal display device according to claim 5, wherein:

the data-line driving circuit selectively outputs the positive-polarity precharge signal and the negative-polarity precharge signal corresponding to the grayscale value and a previous grayscale value which is a grayscale value in a previous frame; and the data-line driving circuit outputs the positive-polarity precharge signal and the negative-polarity precharge signal so that the average of the potential of the positive-polarity precharge signal and the potential of the negative-polarity precharge signal becomes equal to the common potential at least when the previous grayscale value is smaller than the grayscale value.

* * * * *